US009822789B2

(12) United States Patent
Oda et al.

(10) Patent No.: US 9,822,789 B2
(45) Date of Patent: Nov. 21, 2017

(54) TURBO COMPRESSOR AND TURBO REFRIGERATOR

(71) Applicant: IHI Corporation, Tokyo (JP)

(72) Inventors: Kentarou Oda, Tokyo (JP); Seiichiro Yoshinaga, Tokyo (JP); Nobuyoshi Sakuma, Tokyo (JP)

(73) Assignee: DAIKIN INDUSTRIES, LTD. (JP)

( * ) Notice: Subject to any disclaimer, the term of this patent is extended or adjusted under 35 U.S.C. 154(b) by 357 days.

(21) Appl. No.: 14/627,399

(22) Filed: Feb. 20, 2015

(65) Prior Publication Data

US 2015/0167689 A1 Jun. 18, 2015

Related U.S. Application Data

(63) Continuation of application No. PCT/JP2013/072871, filed on Aug. 27, 2013.

(30) Foreign Application Priority Data

Aug. 28, 2012 (JP) ..... 2012-187741

(51) Int. Cl.
*F04D 1/04* (2006.01)
*F04D 29/063* (2006.01)
(Continued)

(52) U.S. Cl.
CPC ..... *F04D 29/061* (2013.01); *F04D 1/04* (2013.01); *F04D 17/12* (2013.01); *F04D 25/02* (2013.01);
(Continued)

(58) Field of Classification Search
CPC ..... F04D 29/061; F04D 29/063; F04D 25/02; F04D 25/06; F04D 25/0606; F04D 1/04;
(Continued)

(56) References Cited

U.S. PATENT DOCUMENTS 3,508,416 A * 4/1970 Miller ..... F04D 27/0246 62/193
5,301,771 A * 4/1994 Sishtla ..... F04D 29/063 184/6.12
(Continued)

FOREIGN PATENT DOCUMENTS

JP 04-224299 8/1992
JP 2003-021097 1/2003
(Continued)

OTHER PUBLICATIONS

International Search Report and Written Opinion dated Sep. 24, 2013 in corresponding PCT International Application No. PCT/JP2013/072871.

*Primary Examiner* — Christopher Verdier
(74) *Attorney, Agent, or Firm* — Ostrolenk Faber LLP

(57) ABSTRACT

A turbo compressor that has a pressure equalizing tube that circulates a gas from a gear unit accommodation space toward an IGV accommodation space, and an oil separation device that is provided in the gear unit accommodation space to separate lubricating oil that is contained in the gas, in which the oil separating device has a suction duct that communicates with the pressure equalizing tube, and the suction duct has a centrifugal separation portion provided with a first demister, a second demister provided on the downstream side of the first demister in relation to the suction direction, and a curved passage provided between the first demister and the second demister.

20 Claims, 5 Drawing Sheets

(51) Int. Cl.

| | |
|---|---|
| ***F25B 43/02*** | (2006.01) |
| ***F04D 29/06*** | (2006.01) |
| ***F04D 29/70*** | (2006.01) |
| ***F25B 1/053*** | (2006.01) |
| ***F25B 1/10*** | (2006.01) |
| ***F04D 17/12*** | (2006.01) |
| ***F25B 1/00*** | (2006.01) |
| ***F04D 25/02*** | (2006.01) |
| *F25B 31/00* | (2006.01) |
| *F25B 25/00* | (2006.01) |

(52) U.S. Cl.
CPC ..... *F04D 29/063* (2013.01); *F04D 29/701* (2013.01); *F25B 1/00* (2013.01); *F25B 1/053* (2013.01); *F25B 1/10* (2013.01); *F25B 31/004* (2013.01); *F25B 43/02* (2013.01); *F05B 2260/98* (2013.01); *F25B 25/005* (2013.01); *F25B 31/002* (2013.01); *F25B 2339/047* (2013.01); *F25B 2400/13* (2013.01); *F25B 2400/23* (2013.01); *F25B 2500/16* (2013.01); *F25B 2600/027* (2013.01)

(58) Field of Classification Search
CPC .... F04D 17/12; F04D 29/701; F05B 2260/60; F05B 2260/602; F05B 2260/604; F05B 2260/98; F25B 31/002; F25B 31/004; F25B 2500/16; F25B 2600/027; F25B 43/02
USPC ..... 184/6.12, 6.16, 6.24, 6.26, 13.1
See application file for complete search history.

(56) References Cited

U.S. PATENT DOCUMENTS

| | | | | |
|---|---|---|---|---|
| 5,404,964 | A * | 4/1995 | Zinsmeyer | F04D 25/02 184/13.1 |
| 5,685,699 | A * | 11/1997 | Holmes | F04D 25/02 29/888.024 |
| 6,018,962 | A * | 2/2000 | Dewhirst | F04D 29/063 62/468 |
| 9,416,681 | B2 * | 8/2016 | Oda | F04D 25/163 |
| 2010/0192571 | A1 | 8/2010 | Böning et al. | 60/605.3 |
| 2011/0016914 | A1 * | 1/2011 | Oda | F04D 17/12 62/468 |

FOREIGN PATENT DOCUMENTS

| | | |
|---|---|---|
| JP | 2009-185710 | 8/2009 |
| JP | 2010-530491 | 9/2010 |
| JP | 2011-026960 | 2/2011 |

* cited by examiner

TURBO COMPRESSOR AND TURBO REFRIGERATOR

CROSS-REFERENCE TO RELATED APPLICATIONS

This application is a Continuation of International Application No. PCT/JP2013/072871, filed on Aug. 27, 2013, claiming priority based on Japanese Patent Application No. 2012-187741, filed Aug. 28, 2012, the contents of both International Application and the Japanese Application are incorporated herein by reference in their entity.

TECHNICAL FIELD

The present invention relates to a turbo compressor and a turbo refrigerator.

BACKGROUND ART

As a turbo compressor that is applied to a turbo refrigerator and the like, there is known in the prior art one that is provided with a housing in which lubricating oil is housed, a large diameter gear as a gear member that is housed in this housing and by whose rotation lubricating oil is supplied, and a demister that is arranged above the large diameter gear in the housing, is provided with an intake port that is in communication with the outside of the housing, and which catches the lubricating oil kicked up by the rotation of the large diameter gear and returns it to below the housing (for example, refer to Patent Document 1).

In this kind of turbo compressor, the intake port of the demister is connected to a space with a lower pressure than the interior of the housing via a pressure equalizing tube, whereby an increase in pressure in the housing is inhibited. Also, in the housing, oil smoke is produced by the lubricating oil that is kicked up by the rotation of the gear member. For this reason, the demister, when suctioning air in the housing from the intake port, prevents the lubricating oil from being discharged to the outside of the housing by catching the lubricating oil that is mixed in the air and returning it to below the housing.

PRIOR ART DOCUMENTS

Patent Documents

[Patent Document 1] Japanese Unexamined Patent Application, First Publication No. 2011-26960

DISCLOSURE OF THE INVENTION

Problems to be Solved by the Invention

However, in the turbo compressor as described above, there is a large quantity of lubricating oil that reaches the demister, and since the lubricating oil cannot be completely caught by the demister, there is a possibility of the lubricating oil being discharged to the outside of the housing.

The present invention is achieved in view of the above circumstances, and has as its object to provide a turbo compressor and a turbo refrigerator that can effectively inhibit discharge of the lubricating oil via a pressure equalizing tube.

Means for Solving the Problems

The first aspect of the present invention is a turbo compressor that has a compression stage that is provided with an impeller that rotates; a housing provided with a first space that in addition to housing lubricating oil houses a gear member that transmits rotating force to the impeller, and a second space in which the ambient pressure becomes lower than the first space; a pressure equalizing tube that circulates a gas from the first space toward the second space; and an oil separating device that is provided in the first space and that separates the lubricating oil contained in the gas, in which the oil separating device has a suction passage that communicates with the pressure equalizing tube; and the suction passage has a centrifugal separation portion that is provided with a first demister, a second demister that, in relation to the suction direction, is provided on the downstream side of the first demister, and a curved passage that is provided between the first demister and the second demister.

In the first aspect of the present invention, it is possible to improve the oil catching capacity by providing a plurality of demisters in the suction passage that communicate with the pressure equalizing tube, and to separate lubricating oil that is contained in the gas by utilizing centrifugal force by taking a distance between the first demister and the second demister and forming a curved passage therebetween. Also, since there is the curved passage, the oil droplets caught by the first demister are hindered from being suctioned into the second demister, and so it is possible to effectively inhibit discharge of the lubricating oil via the pressure equalizing tube.

In the second aspect of the present invention, the centrifugal separation portion in the first aspect, in relation to the rotation direction of the gear member, is provided on the upstream side of the pressure equalizing tube.

In the second aspect of the present invention, it is possible to improve the lubricating oil trapping efficiency by the centrifugal separation in the curved passage by utilizing the swirling flow that accompanies rotation of the gear member.

In the third aspect of the present invention, the curved passage in the first or second aspect has an oil catching portion on the curve outer side.

In the third aspect of the present invention, since the oil catching portion is provided on the curve outer side where the flow of gas increases, it is possible to improve the lubricating oil trapping efficiency by the centrifugal separation in the curved passage.

In the fourth aspect of the present invention, the oil catching portion in the third aspect has a concavo-convex shape.

In the fourth aspect of the present invention, by providing the concavo-convex shape in the curve outer side where the flow of the gas increases, since the lubricating oil contained in the gas collides with the concavo-convex shape, whereby it condenses and easily separates from the gas portion, it is possible to improve the lubricating oil trapping efficiency by the centrifugal separation in the curved passage.

In the fifth aspect of the present invention, the suction passage in any of the first to fourth aspects, as the centrifugal separation portion, has a first centrifugal separation portion that, in relation to the rotation direction of the gear member, is provided on the upstream side of the pressure equalizing tube, and a second centrifugal separation portion that is provided on the downstream side of the pressure equalizing tube.

In the fifth aspect of the present invention, since it is possible to share the oil catching capacity by providing the first centrifugal separation portion and the second centrifugal separation portion, even in the case of the lubricating oil portion contained in the gas being high, it is possible to effectively inhibit the discharge of the lubricating oil via the pressure equalizing tube without easily exceeding the oil catching capacity of the demister.

In the sixth aspect of the present invention, the first curved passage of the first centrifugal separation portion in the fifth aspect is longer than the second curved passage of the second centrifugal portion.

In the sixth aspect of the present invention, since it is possible to utilize the swirling flow that accompanies rotation of the gear member in the first centrifugal separation portion, by lengthening the first curved passage, it is possible to improve the lubricating oil trapping efficiency.

In the seventh aspect of the present invention, the first centrifugal separation portion and the second centrifugal separation portion in the fifth or sixth aspect are integrally connected.

In the seventh aspect of the present invention, since the first centrifugal separation portion and the second centrifugal separation portion are integrally connected, it is possible to simplify handling in the assembling workability.

The eighth aspect of the present invention is a turbo refrigerator that has a condenser that liquefies a compressed refrigerant; an evaporator that by evaporating the refrigerant that is liquefied by the condenser cools a cooling object; and a turbo compressor that compresses the refrigerant that is evaporated by the evaporator and supplies it to the condenser, in which it has the turbo compressor according to any one of the first to seventh aspects as the turbo compressor.

Effects of the Invention

According to the present invention, a turbo compressor and a turbo refrigerator capable of effectively inhibiting the discharge of lubricating oil via a pressure equalizing tube are obtained.

EMBODIMENTS FOR CARRYING OUT THE INVENTION

Figure 1:
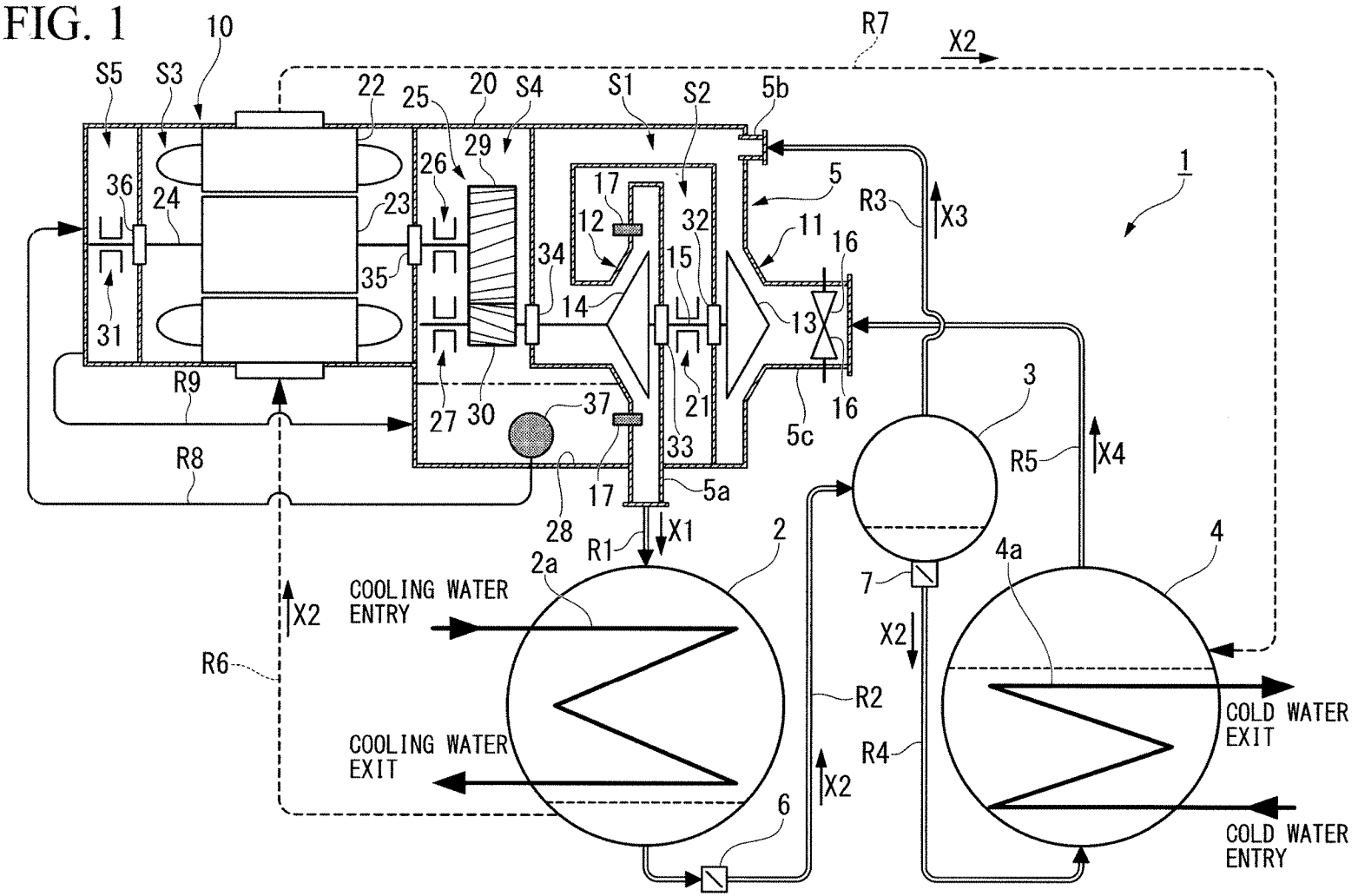
FIG. 1 is a system diagram of the turbo refrigerator in the first embodiment of the present invention.

Hereinbelow, embodiments of the present invention shall be described referring to the drawings.

First Embodiment

FIG. 1 is a system diagram of a turbo refrigerator 1 in the first embodiment of the present invention.

The turbo refrigerator 1 of the present embodiment has cold water for air conditioning as the object to be cooled, with for example Freon serving as the refrigerant. As shown in FIG. 1, the turbo refrigerator 1 is provided with a condenser 2, an economizer 3, an evaporator 4, and a turbo compressor 5.

The condenser 2 is connected with a gas discharge tube 5*a* of the turbo compressor 5 via a flow passage R1. The refrigerant that is compressed by the turbo compressor 5 (the compressed refrigerant gas X1) is supplied to the condenser 2 along the flow passage R1. The condenser 2 liquefies this compressed refrigerant gas X1. The condenser 2 is provided with a heat transfer tube 2*a* through which cooling water circulates, and cools the compressed refrigerant gas X1 by heat exchange between the compressed refrigerant gas X1 and the cooling water.

The compressed refrigerant gas X1 is cooled by the heat exchange with the cooling water, liquefies to become a refrigerant liquid X2, and collects at the bottom of the condenser 2. The bottom of the condenser 2 is connected with an economizer 3 via a flow passage R2. An expansion valve 6 that decompresses the refrigerant liquid X2 is provided in the flow passage R2. The refrigerant liquid X2 that is decompressed by the expansion valve 6 is supplied to the economizer 3 through the flow passage R2. The economizer 3 stores the decompressed refrigerant liquid X2 temporarily, and separates the refrigerant into a liquid phase and a gas phase.

The top portion of the economizer 3 is connected with an economizer connecting tube 5*b* of the turbo compressor 5 via a flow passage R3. The gas phase component X3 of the refrigerant separated by the economizer 3 is supplied through the flow passage R3 to a second compression stage 12 in the turbo compressor 5 without passing through the evaporator 4 and a first compression stage 11, and enhances efficiency. On the other hand, the bottom portion of the economizer 3 is connected with the evaporator 4 via a flow passage R4. An expansion valve 7 for further decompressing the refrigerant liquid X2 is provided in the flow passage R4.

The refrigerant liquid X2 that is decompressed further by the expansion valve 7 is supplied to the evaporator 4 through the flow passage R4. By evaporating the refrigerant liquid X2, the evaporator 4 cools cold water with the evaporation heat. The evaporator 4 is provided with a heat-transfer tube 4*a* through which the cold water circulates, and cools the cold water and evaporates the refrigerant liquid X2 by the heat exchange between the refrigerant liquid X2 and the cold water. By the heat exchange with the cold water, the refrigerant liquid X2 draws heat, evaporates, and becomes refrigerant gas X4.

The top portion of the evaporator 4 is connected with a gas suction tube 5*c* of the turbo compressor 5 via a flow passage R5. The refrigerant gas X4 which evaporates in the evaporator 4 is supplied to the turbo compressor 5 through the flow passage R5. The turbo compressor 5 compresses the refrigerant gas X4 which is evaporated, and supplies it to the condenser 2 as compressed refrigerant gas X1. The turbo compressor 5 is a two-stage compressor that is provided with the first compression stage 11 that compresses the refrigerant gas X4, and the second compression stage 12 that further compresses the refrigerant that is subjected to one stage of compression.

An impeller 13 is provided in the first compression stage 11, an impeller 14 is provided in the second compression stage 12, and they are connected by a rotation shaft 15. The turbo compressor 5 compresses the refrigerant by rotating the impellers 13 and 14 with an electric motor 10. The impellers 13 and 14 are radial impellers and have blades with three-dimensional torsion, not illustrated, that discharge in the radial direction refrigerant taken in in the axial direction.

An inlet guide vane 16 that adjusts the suction quantity of the first compression stage 11 is provided in the gas suction tube 5*c*. The inlet guide vane 16 is made rotatable so that the apparent area from the flow direction of the refrigerant gas X4 can be changed. A diffuser flow passage is provided around each of the impellers 13 and 14, and the refrigerant that is ejected in the radial direction is compressed and raised in pressure in these flow passages. Moreover, it is possible to supply the refrigerant to the next compression stage by a scroll flow passage that is provided around the impellers 13 and 14. An outlet throttle valve 17 is provided around the impeller 14, whereby the outlet throttle valve 17 can control the discharge amount from the gas discharge tube 5*a*.

The turbo compressor 5 is equipped with an enclosed-type housing 20. The housing 20 is divided into a compression flow passage space S1, a first bearing accommodation space S2, a motor accommodation space S3, a gear unit accommodation space (first space) S4, a second bearing accommodation space S5, and an inlet guide vane driving mechanism accommodation space (second space) S6 (hereinbelow called IGV space S6. It is not illustrated in FIG. 1, so refer to FIG. 2 described below). The impellers 13 and 14 are provided in the compression flow passage space S1. The rotation shaft 15 which connects the impellers 13 and 14 is provided inserted in the compression flow passage space S1, the first bearing accommodation space S2, and the gear unit accommodation space S4. A bearing 21 that supports the rotation shaft 15 is provided in the first bearing accommodation space S2.

A stator 22, a rotor 23, and a rotation shaft 24 connected to the rotor 23 are provided in the motor accommodation space S3. This rotation shaft 24 is provided inserted in the motor accommodation space S3, the gear unit accommodation space S4, and the second bearing accommodation space S5. A bearing 31 that supports the anti-load side of the rotation shaft 24 is provided in the second bearing accommodation space S5. A gear unit 25, bearings 26 and 27, and an oil tank 28 are provided in the gear unit accommodation space S4.

A gear unit 25 has a large diameter gear 29 fixed to the rotation shaft 24, and a small diameter gear 30 that is fixed to the rotation shaft 15 and meshes with the large diameter gear 29. The gear unit 25 transmits rotating force so that the rotation frequency of the rotation shaft 15 may increase (become faster) with respect to the rotation frequency of the rotation shaft 24. The bearing 26 supports the rotation shaft 24. The bearing 27 supports the rotation shaft 15. The oil tank 28 stores the lubricating oil supplied to each sliding part of the bearings 21, 26, 27, 31 and the like.

In this kind of housing 20, seal portions 32 and 33 that seal the periphery of the rotation shaft 15 are provided between the compression flow passage space S1 and the first bearing accommodation space S2. Moreover, in the housing 20, a seal portion 34 that seals the periphery of the rotation shaft 15 is provided between the compression flow passage space S1 and the gear unit accommodation space S4. Also, in the housing 20, a seal portion 35 that seals the periphery of the rotation shaft 24 is provided between the gear unit accommodation space S4 and the motor accommodation space S3. Also, in the housing 20, a seal portion 36 that seals the periphery of the rotation shaft 24 is provided between the motor accommodation space S3 and the second bearing accommodation space S5.

The motor accommodation space S3 is connected with the condenser 2 via a flow passage R6. The refrigerant liquid X2 is supplied to the motor accommodation space S3 from the condenser 2 through the flow passage R6. The refrigerant liquid X2 that is supplied to the motor accommodation space S3 circulates around the stator 22, and by heat exchange with the stator 22 and its surroundings, cools the motor accommodation space S3. The motor accommodation space S3 is connected with the evaporator 4 via the flow passage R7. The refrigerant liquid X2 that has drawn the heat in the motor accommodation space S3 is supplied to the evaporator 4 via a flow passage R7.

The oil tank 28 has a siphon pump 37. The siphon pump 37 is connected with the second bearing accommodation space S5 via for example a flow passage R8. Lubricating oil is supplied from the oil tank 28 to the second bearing accommodation space S5 through the flow passage R8. The lubricating oil supplied to the second bearing accommodation space S5 is supplied to the bearing 31, and secures the lubricity of the sliding portions of the rotating shaft 24 as well as inhibits the generation of heat of the sliding portions (performs cooling). The second bearing accommodation space S5 is connected with the oil tank 28 via a flow passage R9. The lubricating oil supplied to the second bearing accommodation space S5 returns to the oil tank 28 through the flow passage R9.

Here, some of the refrigerant liquid X2 supplied to the motor accommodation space S3 evaporates, whereby the ambient pressure of the motor accommodation space S3 becomes high. When the refrigerant liquid X2 is leaked out from for example the seal portion 35 to the gear unit accommodation space S4, the ambient pressure of the gear unit accommodation space S4 becomes high. In the gear unit accommodation space S4 is provided the oil tank 28 to which the lubricating oil returns from each sliding portion via the flow passage R9. For that reason, when the ambient pressure of the gear unit accommodation space S4 becomes high in this way, there results a reduction in the lubricating oil that returns to the oil tank 28.

Figure 2:
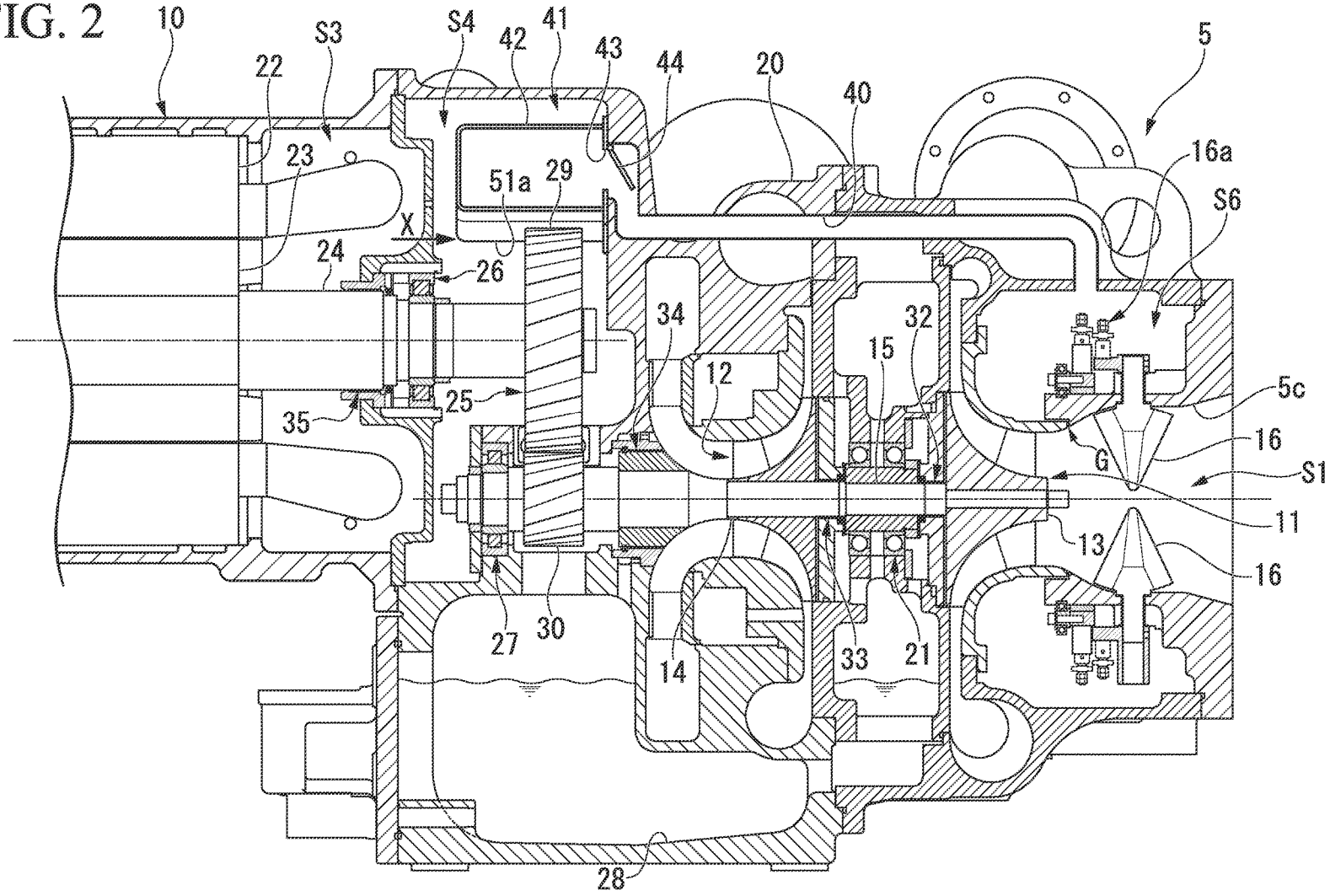
FIG. 2 is a cross-sectional view of a turbo compressor in the first embodiment of the present invention.

For this reason, the turbo compressor 5 is equipped with the constitution shown in FIG. 2.

FIG. 2 is a cross-sectional view of the turbo compressor 5 in the first embodiment of the present invention.

The turbo compressor 5 has a pressure equalizing tube 40 that brings the gear unit accommodation space S4 and the IGV accommodation space S6 into communication as shown in FIG. 2. A drive mechanism 16*a* of the inlet guide vane 16 is provided in the IGV accommodation space S6. The IGV accommodation space S6 is provided in an annular shape around the first compression stage 11 and the gas suction tube 5*c*. The IGV accommodation space S6 communicates with the compression flow passage space S1 at the gas suction tube 5*c* of the upstream side of the first compression stage 11 via a gap G formed in the housing 20.

The compression flow passage space S1 which is communicated by the gap G enters a negative pressure state when the impeller 13 rotates at the intake side of the first compression stage 11, and the ambient pressure becomes the lowest in the enclosed-type housing 20. The ambient pressure becomes low because the IGV accommodation space S6 is communicated with the compression flow passage space S1 via the gap G. The pressure equalizing tube 40, by connecting the space between this IGV accommodation space S6 and the gear unit accommodation space S4, circulates the gas of the gear unit accommodation space S4 from the gear unit accommodation space S4 toward the IGV accommodation space S6, and reduces the ambient pressure of the gear unit accommodation space S4.

The lubricating oil is kicked up, and oil droplets and oil smoke are generated, by the large diameter gear 29 that transmits rotating force particularly to the impellers 13 and 14 of the gear unit 25 in the gear unit accommodation space S4. This lubricating oil, when discharged to the IGV accommodation space S6 by being carried by the air flow in the pressure equalizing tube 40, is introduced from the IGV accommodation space S6 to the compression flow passage space S1, and collects in the condenser 2, the evaporator 4, or the like. Then, the lubricating oil in the oil tank 28 may decrease, and the so-called phenomenon of oil loss may occur, whereby the supply amount of lubricating oil to the sliding portions may become insufficient. Therefore, an oil separating device 41 that separates the lubricating oil contained in the gas is provided in the gear unit accommodation space S4.

Figure 3:
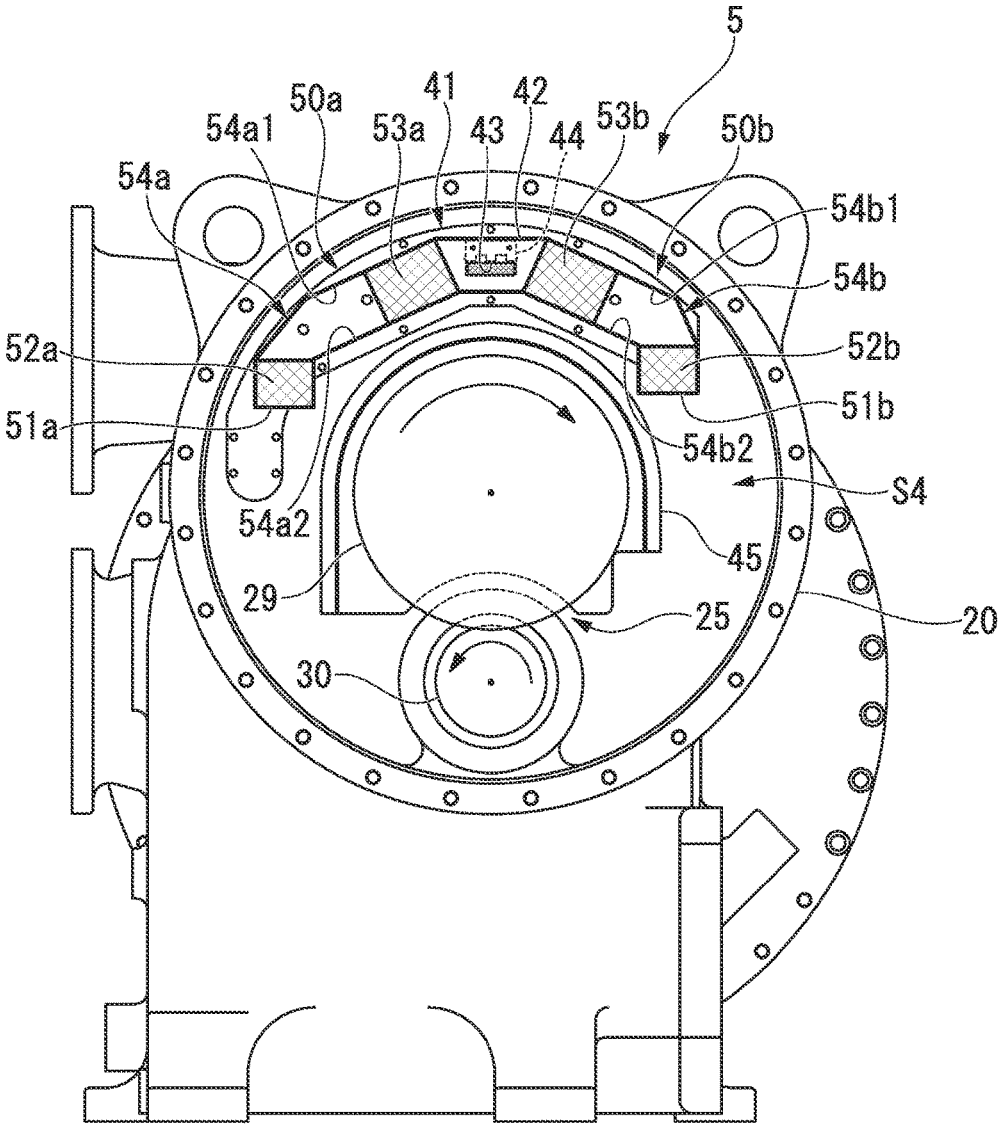
FIG. 3 is a schematic diagram of an oil separating device seen from the arrow X direction in FIG. 2.
Figure 4:
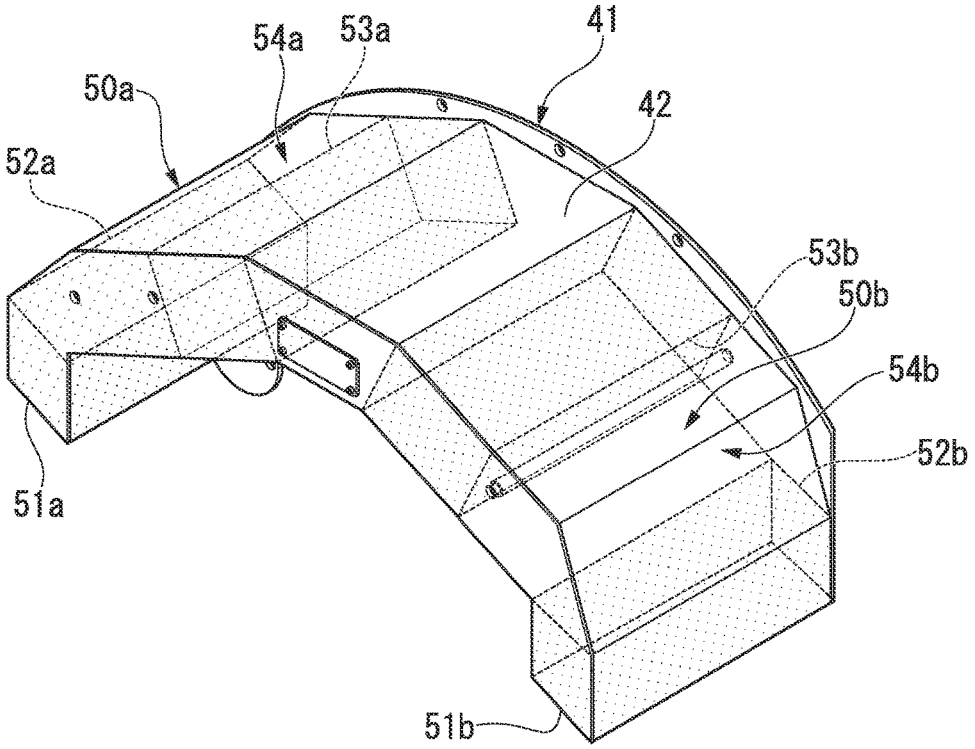
FIG. 4 is a perspective view of the oil separating device in the first embodiment of the present invention.

FIG. 3 is a schematic diagram of the oil separating device 41 seen from the arrow X direction in FIG. 2. FIG. 4 is a perspective view of the oil separating device 41 in the first embodiment of the present invention.

As shown in FIG. 3, the oil separating device 41 is arranged above the large-diameter gear 29, and is fixed by a fixing member such as a bolt to the housing 20. A cover member 45 (not illustrated in FIG. 2) that inhibits scattering of oil droplets kicked up by the rotation of the large diameter gear 29 is provided around the large diameter gear 29. The upstream side of the cover member 45 in the rotation direction of the large diameter gear 29 is formed longer heading downward than the downstream side thereof. Accordingly, the cover member 45 can effectively receive the oil droplets of the lubricating oil at the upstream side of the large diameter gear 29 where the oil droplet scattering amount is abundant.

The oil separating device 41 has a suction duct (suction passage) 42. The suction duct 42 has an interconnecting opening 43 that communicates with the pressure equalizing tube 40. A check valve 44 is provided in the interconnecting opening 43 (refer to FIG. 2). The check valve 44 prevents back flow of the gas of the IGV accommodation space S6 which heads from the IGV accommodation space S6 to the gear unit accommodation space S4. When shutting down the turbo compressor 5, the refrigerant flows backwards from the condenser 2 to the turbo compressor 5, and so the ambient pressure of the compression flow passage space S1 and the IGV accommodation space S6 may become higher than the gear unit accommodation space S4. In this case, the check valve 44 can prevent the back flow of the gas.

As shown in FIG. 3, in relation to the rotation direction of the large diameter gear 29, the suction duct 42 has a first centrifugal separation portion 50*a* provided further to the upstream side of the rotation direction of the large diameter gear 29 than the interconnecting opening 43, and a second centrifugal separation portion 50*b* provided further to the downstream in the rotation direction of the large diameter gear 29 than the interconnecting opening 43. The first centrifugal separation portion 50*a* has a suction port 51*a* that opens downward. The second centrifugal separation portion 50*b* has a suction port 51*b* that opens downward. In this way, the suction duct 42 of the present embodiment suctions gas of the gear unit accommodation space S4 from the two suction ports 51*a* and 51*b*, and discharges the gas from the one interconnecting opening 43 to the pressure equalizing tube 40.

The first centrifugal separation portion 50*a* has a first demister 52*a*, a second demister 53*a*, and a curved passage (first curved passage) 54*a*, as shown in FIG. 3. The first demister 52*a* is provided at the suction port 51*a*. In this first demister 52*a*, a metal catching member with a lattice shape or mesh shape with a predetermined length is filled from the suction port 51*a* heading upward into the interior. On the other hand, the second demister 53*a* is provided further to the downstream side in the rotation direction of the large diameter gear 29 than the first demister 52*a* and further to the upstream side in the rotation direction of the large diameter gear 29 than the interconnecting opening 43. In this second demister 53*a* a metal catching member with a lattice shape or mesh shape with a length longer than the first demister 52*a* is filled heading obliquely upward in the duct interior.

The curved passage 54*a* is provided between the first demister 52*a* and the second demister 53*a*. A catching member is not filled in the curved passage 54*a*, so the interior is hollow.

The curved passage 54*a* curves along the rotation direction of the large diameter gear 29. In the curved passage 54*a* of the present embodiment, a curve outer side 54*a*1 is formed by two planes intersecting at an obtuse angle by bending of a sheet metal. A curve inner side 54*a*2 of the curved passage 54*a* is formed by a single plane. In this kind of curved passage 54*a*, during the process in which gas passes, the orientation of the gas circulation direction in the first demister 52*a* and the orientation of the gas circulation direction in the second demister 53*a* are made to differ.

The second centrifugal separation portion 50*b* has approximately the same constitution arranged symmetrically with the first centrifugal separation portion 50*a*, having a first demister 52*b*, a second demister 53*b*, and a curved passage (second curved passage) 54*b*. The constitutions of the first demister 52*b* and the second demister 53*b* of the second centrifugal separation portion 50*b* are the same as the constitutions of the first demister 52*a* and the second demister 53*a* of the first centrifugal separation portion 50*a*. However, the constitution of the curved passage 54*b* of the second centrifugal separation portion 50*b* differs from the constitution of the curved passage 54*a* of the first centrifugal separation portion 50*a*.

Specifically, in the curved passage 54*b* of the second centrifugal separation portion 50*b*, the constitutions of the curve outer side 54*b*1 and the curve inner side 54*b*2 are the same as those of the curved passage 54*a* of the first centrifugal separation portion 50*a*. However, the curved passage 54*b* of the second centrifugal separation portion 50*b* has a shorter passage than the curved passage 54*a* of the first centrifugal separation portion 50*a*. That is, the curved passage 54*a* of the first centrifugal separation portion 50*a* is relatively longer. This kind of second centrifugal separation portion 50*b* is integrally connected with the first centrifugal separation portion 50*a*.

Figure 5:
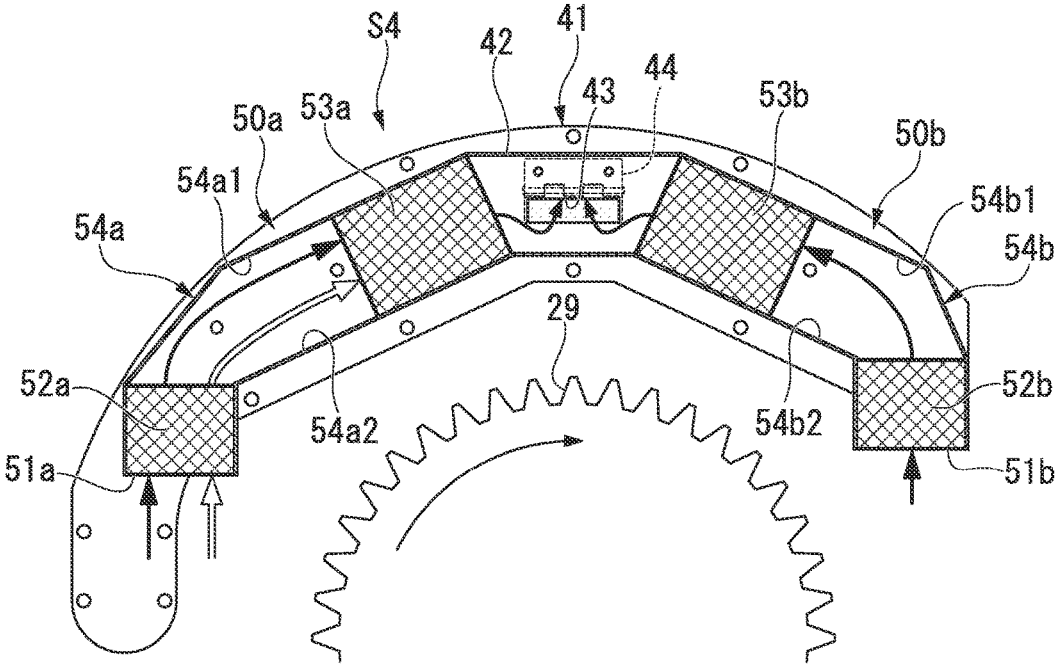
FIG. 5 is an explanatory view of the action of the oil separating device in the first embodiment of the present invention.

Next, the action of the oil separating device 41 with the aforementioned constitution shall be described referring to FIG. 5. FIG. 5 is an explanatory view of the action of the oil separating device 41 in the first embodiment of the present invention.

In the gear unit accommodation space S4, lubricating oil is kicked up by the large diameter gear 29 that transmits rotating force particularly to the impellers 13 and 14 of the gear unit 25, whereby oil droplets and oil smoke are produced. The oil separating device 41, which separates the lubricating oil that has become oil droplets and oil smoke from the gas portion, is provided in the gear unit accommodation space S4. As shown in FIG. 5, the oil separating device 41 has the suction duct 42 having the interconnecting opening 43 that communicates with the pressure equalizing tube 40, and separates the lubricating oil contained in the gas in the process of passing through this suction duct 42.

The suction duct 42 has the first centrifugal separation portion 50*a*. Gas that is suctioned from the suction port 51*a* of the first centrifugal separation portion 50*a* passes through the first demister 52*a*. The first demister 52*a* consists of a lattice-shaped member or mesh-like member, and when gas passes through it can catch the lubricating oil contained in this gas. The lubricating oil that is caught by the first demister 52*a* drips by its own weight from the suction port 51*a* which opens to below the gear unit accommodation space S4, and is recovered by the oil tank 28 (refer to FIG. 28).

The gas that has passed through the first demister 52*a* circulates through the curved passage 54*a*. The curved passage 54*a*, by bending the flow passage of the gas, applies centrifugal force to the gas during passes through the curve. The lubricating oil that is contained in the gas to which the centrifugal force is applied, when passing through the curved passage 54*a*, collides with the curve outer side 54*a*1, whereby oil droplets are removed. The lubricating oil that is removed in the curved passage 54*a* falls for example toward the bottom of the gear unit accommodation space S4, moves along the curve inner side 54*a*2 which is a downward slope, and drips from the suction portion 51*a* via the first demister 52*a* by the self weight of the lubricating oil, and is collected by the oil tank 28 (refer to FIG. 2).

The gas that has passed through the curved passage 54*a* circulates through the second demister 53*a*. The second demister 53*a* consists of a lattice-shaped member or mesh-like member, and when gas passes through it can catch the lubricating oil contained in this gas. The second demister 53*a* is longer than the first demister 52*a*, and can reliably catch trace amounts of lubricating oil that are not removed by the first demister 52*a* and the curved passage 54*a*. The gas from which the lubricating oil is removed by passing through the second demister 53*a* passes through the pressure equalizing tube 40 from the interconnecting opening 43, to flow out to the IGV accommodation space S6.

In this way, in the present embodiment, a plurality of demisters are provided in the suction duct 42 that communicates with the pressure equalizing tube 40 to enhance the oil catching capacity, and in addition distance is acquired between the first demister 52*a* and the second demister 53*a* and the curved passage 54*a* is formed therebetween, whereby it is possible to separate the lubricating oil that is contained in the gas by utilizing the centrifugal force. Also, since there is the curved passage 54*a*, the oil droplets that are caught by the first demister 52*a* are hindered from being suctioned into the second demister 53*a*. That is to say, compared with the case of packing the demister from the suction port 51*a* to just short of the interconnecting opening 43, it is possible to effectively inhibit discharge of the lubricating oil via the pressure equalizing tube 40.

Note that this kind of oil separation action can be similarly obtained in the second centrifugal separation portion 50*b*. In the present embodiment, by providing the first centrifugal separation portion 50*a* and the second centrifugal separation portion 50*b*, it is possible to share the oil catching capacity. For this reason, even in the case of the lubricating oil portion contained in the gas being high, it is possible to effectively inhibit the discharge of the lubricating oil via the pressure equalizing tube 40. Also, in the present embodiment, since the first centrifugal separation portion 50*a* and the second centrifugal separation portion 50*b* are integrally connected, handling is easy, and it is possible to enhance the assembling workability.

Also, in relation to the rotation direction of the large diameter gear 29, in the first centrifugal separation portion 50*a* that is provided further on the upstream side than the interconnecting opening 43 that communicates with the pressure equalizing tube 40, the following action is obtained.

In the gear unit accommodation space S4, a swirling flow is generated around the large diameter gear 29 by the rotation of the large diameter gear 29. As a result, in the curved passage 54*a* of the first centrifugal separation portion 50*a*, in addition to the gas circulation by the ambient pressure difference between the gear unit accommodation space S4 and the IGV accommodation space S6, since gas circulation due to the swirling flow (depicted by the outlined arrows in FIG. 5) is also applied, the gas flow speed increases, leading to the exertion of a greater centrifugal force.

For this reason, since the centrifugal force is great in the curved passage 54*a* of the first centrifugal separation portion 50*a*, it is possible to improve the lubricating oil trapping efficiency by the centrifugal separation in the curved passage 54*a* by utilizing the swirling flow that accompanies rotation of the large diameter gear 29. Also, since the curved passage 54*a* of the first centrifugal separation portion 50*a* of the present embodiment is longer than the curved passage 54*b* of the second centrifugal separation portion 50*b*, it is possible to secure a broader region that can utilize the swirling flow that accompanies rotation of the large diameter gear 29, and it is possible to further improve the lubricating oil trapping efficiency.

That is to say, the embodiment given above has the compression stages 11 and 12 that are provided with the impellers 13 and 14 that rotate; the housing 20 provided with the gear unit accommodation space S4 that in addition to housing the lubricating oil houses the large diameter gear 29 that transmits the rotating force to the impellers 13 and 14, and the IGV accommodation space S6 in which the ambient pressure becomes lower than this gear unit accommodation space S4; the pressure equalizing tube 40 that circulates the gas of the gear unit accommodation space S4 from the gear unit accommodation space S4 toward the IGV accommodation space S6, and the oil separating device 41 that is provided in the gear unit accommodation space S4 and that separates the lubricating oil contained in the gas. Also, the oil separating device 41 has the suction duct 42 that communicates with the pressure equalizing tube 40, and the suction duct 42 has the centrifugal separation portions 50*a* and 50*b* that are provided with the first demisters 52*a* and 52*b*, the second demisters 53*a* and 53*b* that are provided on the downstream side of the first demisters 52*a* and 52*b* in relation to the suction direction, and the curved passages 54*a* and 54*b* that are provided between the first demisters 52 and 52*b* and the second demisters 53*a* and 53*b*. It is possible to effectively inhibit discharge of the lubricating oil via the pressure equalizing tube 40 by the turbo compressor 5 that is provided with the centrifugal separation portions 50*a* and 50*b*.

Second Embodiment

Next, the second embodiment of the present invention shall be described. In the following description, the same reference numerals shall be given to the constituent portions having the same or similar constitution as the embodiment given above, with descriptions thereof being simplified or omitted.

Figure 6:
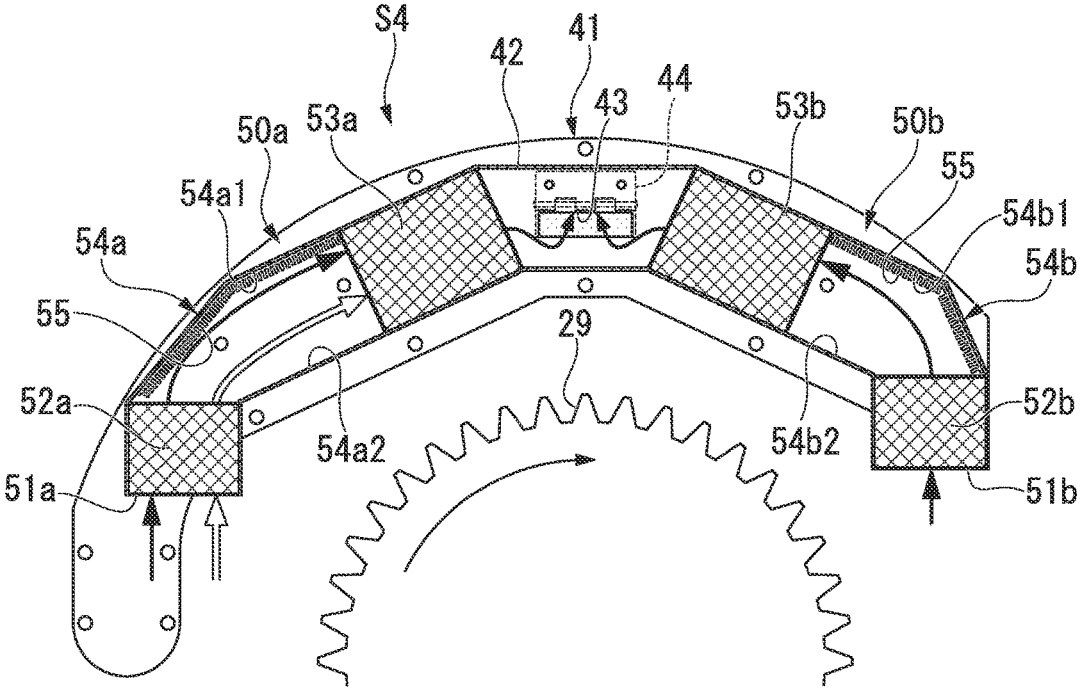
FIG. 6 is an explanatory view of the constitution and action of the oil separating device in the second embodiment of the present invention.

FIG. 6 is an explanatory view of the constitution and action of the oil separating device 41 in the second embodiment of the present invention.

As shown in FIG. 6, the second embodiment differs from the embodiment given above on the point of an oil catching portion 55 being provided.

The oil catching portion 55 is provided in the curve outer side 54*a*1 at which the gas flow speeds up in the curved passage 54*a*. The oil catching portion 55 is a collision plate, and has the fine concavo-convex shape provided from the curve outer side 54*a*1 toward the curve inner side 54*a*2. Note that the oil catching portion 55 may be a mesh-like member such as punching metal or expanded metal, and may also have a bent shape in which the distal end of the convex portion is bent in a round shape toward the upstream side in the suction direction.

This kind of oil catching portion 55 is provided similarly in the curved passage 54*b*.

According to the second embodiment with the constitution given above, since the oil catching portion 55 is provided in the curve outer side 54*a*1 where the flow of the gas increases, it is possible to improve the lubricating oil trapping efficiency by the centrifugal separation in the curved passage 54*a*. Also, by providing the concavo-convex shape in the curve outer side where the gas flow quickens, the lubricating oil that is contained in the gas collides with the concavo-convex shape, whereby it condenses and easily separates from the gas portion. Therefore, it is possible to further improve the lubricating oil trapping efficiency by the centrifugal separation in the curved passage 54*a*. Note that this action effect can similarly be obtained in the curved passage 54*b* as well.

Hereinabove, the preferred embodiments of the present invention are described while referring to the drawings, but the present invention is not limited to the aforementioned embodiments. The various shapes and combinations of each composite member shown in the embodiments described above refer to only a single example, and various modifications are possible based on design requirements and so forth within a scope that does not deviate from the subject matter of the present invention.

For example, in the embodiments given above, a description is given for a mode in which two centrifugal separation portions are provided, but the present invention is not limited to this constitution, and for example there may be only one centrifugal separation portion.

Also, for example, in the embodiments given above, a description is given for a mode in which the suction passage has a duct shape, but the present invention is not limited to this constitution, and for example the suction passage may also have a tube shape.

In addition, for example, in the embodiments given above, a description is given for a mode in which the curved passage is bent, but the present invention is not limited to this constitution, and for example the curved passage may be curved in a rounded shape.

INDUSTRIAL APPLICABILITY

According to the turbo compressor and the turbo refrigerator of the present invention, it is possible to effectively inhibit the discharge of lubricating oil via a pressure equalizing tube.

DESCRIPTION OF THE REFERENCE SYMBOLS

1: Turbo refrigerator
2: Condenser
4: Evaporator
5: Turbo compressor
11: First compression stage (compression stage)
12: Second compression stage (compression stage)
13: Impeller
14: Impeller
20: Housing
29: Large diameter gear (gear member)
40: Pressure equalizing tube
41: Oil separating device
42: Suction duct (suction passage)
50*a*: First centrifugal separation portion (centrifugal separation portion)
50*b*: Second centrifugal separation portion (centrifugal separation portion)
52*a*: First demister
52*b*: First demister
53*a*: Second demister
53*b*: Second demister
54*a*: Curved passage
54*a*1: Curve outer side
54*b*: Curved passage
54*b*1: Curve outer side
55: Oil catching portion
S4: Gear unit accommodation space (first space)
S6: IGV accommodation space (second space)

The invention claimed is:

1. A turbo compressor comprising:

a compression stage that is provided with an impeller that rotates;

a housing provided with a first space that in addition to housing lubricating oil houses a gear member that transmits rotating force to the impeller, and a second space in which the ambient pressure becomes lower than the first space;

a pressure equalizing tube that circulates a gas from the first space toward the second space; and an oil separating device that is provided in the first space and that separates the lubricating oil contained in the gas, wherein the oil separating device has a suction passage that communicates with the pressure equalizing tube; and the suction passage has:

a suction port which opens to the first space and from which the suction passage suctions the gas of the first space, an interconnecting opening which communicates with the pressure equalizing tube and from which the suction passage discharges the gas to the pressure equalizing tube, and a centrifugal separation portion that is provided with a first demister, a second demister that, in relation to a flow direction of the gas from the suction port to the interconnecting opening in the suction passage, is provided on the downstream side of the first demister, and a curved passage that is provided between the first demister and the second demister.

2. The turbo compressor according to claim 1, wherein the centrifugal separation portion, in relation to the rotation direction of the gear member, is provided on the upstream side of the pressure equalizing tube.

3. The turbo compressor according to claim 1, wherein the curved passage has an oil catching portion on the curved outer side of the curved passage.

4. The turbo compressor according to claim 2, wherein the curved passage has an oil catching portion on the curved outer side of the curved passage.

5. The turbo compressor according to claim 3, wherein the oil catching portion has a concavo-convex shape.

6. The turbo compressor according to claim 4, wherein the oil catching portion has a concavo-convex shape.

7. The turbo compressor according to claim 1, wherein the centrifugal separation portion comprises a first centrifugal separation portion that, in relation to the rotation direction of the gear member, is provided on the upstream side of the pressure equalizing tube, and a second centrifugal separation portion that is provided on the downstream side of the pressure equalizing tube.

8. The turbo compressor according to claim 2, wherein the centrifugal separation portion comprises a first centrifugal separation portion that, in relation to the rotation direction of the gear member, is provided on the upstream side of the pressure equalizing tube, and a second centrifugal separation portion that is provided on the downstream side of the pressure equalizing tube.

9. The turbo compressor according to claim 3, wherein the centrifugal separation portion comprises a first centrifugal separation portion that, in relation to the rotation direction of the gear member, is provided on the upstream side of the pressure equalizing tube, and a second centrifugal separation portion that is provided on the downstream side of the pressure equalizing tube.

10. The turbo compressor according to claim 4, wherein the centrifugal separation portion comprises a first centrifugal separation portion that, in relation to the rotation direction of the gear member, is provided on the upstream side of the pressure equalizing tube, and a second centrifugal separation portion that is provided on the downstream side of the pressure equalizing tube.

11. The turbo compressor according to claim 5, wherein the centrifugal separation portion comprises a first centrifugal separation portion that, in relation to the rotation direction of the gear member, is provided on the upstream side of the pressure equalizing tube, and a second centrifugal separation portion that is provided on the downstream side of the pressure equalizing tube.

12. The turbo compressor according to claim 6, wherein the centrifugal separation portion comprises a first centrifugal separation portion that, in relation to the rotation direction of the gear member, is provided on the upstream side of the pressure equalizing tube, and a second centrifugal separation portion that is provided on the downstream side of the pressure equalizing tube.

13. The turbo compressor according to claim 7, wherein the curved passage comprises a first curved passage of the first centrifugal separation portion and a second curved passage of the second centrifugal separation portion and the first curved passage of the first centrifugal separation portion is longer than the second curved passage of the second centrifugal separation portion.

14. The turbo compressor according to claim 8, wherein the curved passage comprises a first curved passage of the first centrifugal separation portion and a second curved passage of the second centrifugal separation portion and the first curved passage of the first centrifugal separation portion is longer than the second curved passage of the second centrifugal separation portion.

15. The turbo compressor according to claim 9, wherein the curved passage comprises a first curved passage of the first centrifugal separation portion and a second curved passage of the second centrifugal separation portion and the first curved passage of the first centrifugal separation portion is longer than the second curved passage of the second centrifugal separation portion.

16. The turbo compressor according to claim 10, wherein the curved passage comprises a first curved passage of the first centrifugal separation portion and a second curved passage of the second centrifugal separation portion and the first curved passage of the first centrifugal separation portion is longer than the second curved passage of the second centrifugal separation portion.

17. The turbo compressor according to claim 11, wherein the curved passage comprises a first curved passage of the first centrifugal separation portion and a second curved passage of the second centrifugal separation portion and the first curved passage of the first centrifugal separation portion is longer than the second curved passage of the second centrifugal separation portion.

18. The turbo compressor according to claim 12, wherein the curved passage comprises a first curved passage of the first centrifugal separation portion and a second curved passage of the second centrifugal separation portion and the first curved passage of the first centrifugal separation portion is longer than the second curved passage of the second centrifugal separation portion.

19. The turbo compressor according to claim 7, wherein the first centrifugal separation portion and the second centrifugal separation portion are integrally connected.

20. A turbo refrigerator comprising:

a condenser that liquefies a compressed refrigerant;

an evaporator that by evaporating the refrigerant that is liquefied by the condenser cools a cooling object; and a turbo compressor that compresses the refrigerant that is evaporated by the evaporator and supplies it to the condenser, wherein the turbo refrigerator is provided with the turbo compressor according to claim 1 as the turbo compressor.

* * * * *